US008091747B2

(12) United States Patent
Haan

(10) Patent No.: US 8,091,747 B2
(45) Date of Patent: Jan. 10, 2012

(54) HANGER FOR GARMENT STEAMER

(76) Inventor: Gyung-Hee Haan, Seoul (KR)

( * ) Notice: Subject to any disclaimer, the term of this patent is extended or adjusted under 35 U.S.C. 154(b) by 551 days.

(21) Appl. No.: 12/293,006

(22) PCT Filed: Mar. 15, 2007

(86) PCT No.: PCT/KR2007/001282

§ 371 (c)(1),
(2), (4) Date: Jan. 16, 2009

(87) PCT Pub. No.: WO2007/108606

PCT Pub. Date: Sep. 27, 2007

(65) Prior Publication Data

US 2009/0173758 A1 Jul. 9, 2009

(30) Foreign Application Priority Data

Mar. 17, 2006 (KR) ..... 10-2006-0024771
Mar. 17, 2006 (KR) ..... 20-2006-0007275 U

(51) Int. Cl.
*A41D 27/22* (2006.01)

(52) U.S. Cl. ..... 223/90

(58) Field of Classification Search ..... 223/85, 223/89, 90, 91, 93, 96, 120
See application file for complete search history.

(56) References Cited

U.S. PATENT DOCUMENTS

| | | | | | |
|---|---|---|---|---|---|
| 1,780,153 | A * | 11/1930 | Francsics | ..... | 223/95 |
| 2,232,249 | A * | 2/1941 | Losin | ..... | 24/716 |
| 2,498,866 | A * | 2/1950 | Suhajda | ..... | 223/85 |
| 2,633,276 | A * | 3/1953 | Gillespieet al. | ..... | 223/90 |
| 5,007,562 | A * | 4/1991 | Brink et al. | ..... | 223/89 |
| 5,044,534 | A * | 9/1991 | Hwang | ..... | 223/94 |
| 5,590,823 | A * | 1/1997 | Lunde | ..... | 223/94 |
| 5,598,957 | A * | 2/1997 | Bell | ..... | 223/94 |
| 5,992,714 | A * | 11/1999 | Morgan | ..... | 223/96 |
| 6,808,093 | B1 * | 10/2004 | Lin et al. | ..... | 223/85 |
| 6,910,291 | B2 | 6/2005 | Schwass | | |
| 2003/0037469 | A1 | 2/2003 | Schwass | | |
| 2005/0132761 | A1 * | 6/2005 | Carrubba et al. | ..... | 68/222 |
| 2008/0217364 | A1 * | 9/2008 | Fong | ..... | 223/90 |

* cited by examiner

*Primary Examiner* — Shaun R Hurley
(74) *Attorney, Agent, or Firm* — Rothwell, Figg, Ernst & Manbeck, P.C.

(57) ABSTRACT

A hanger for a garment steamer that is adapted for unrumpling clothing such as trousers, jackets, or the like, having a hub, arms, ribs, a hinge for connecting one end of each rib to an end of each arm, and joining means for connecting the other end of each rib to the hub.

4 Claims, 18 Drawing Sheets

【Figure 1】
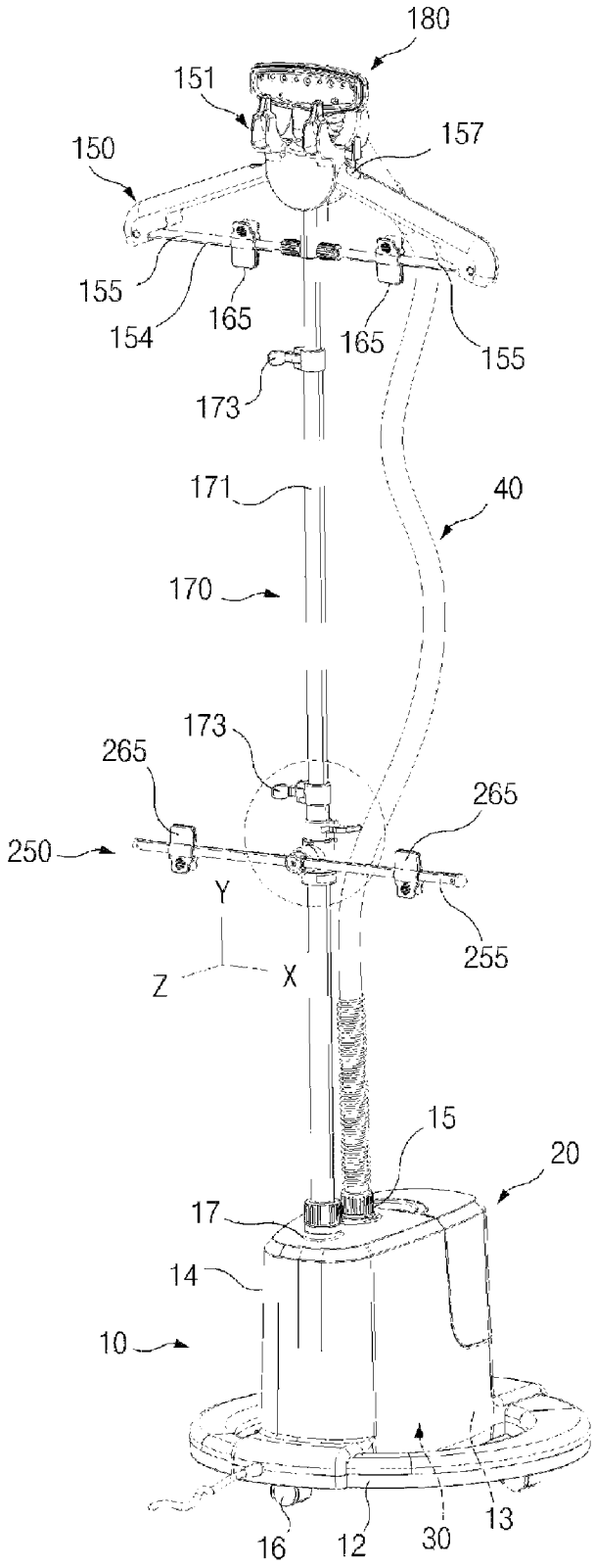

【Figure 2】
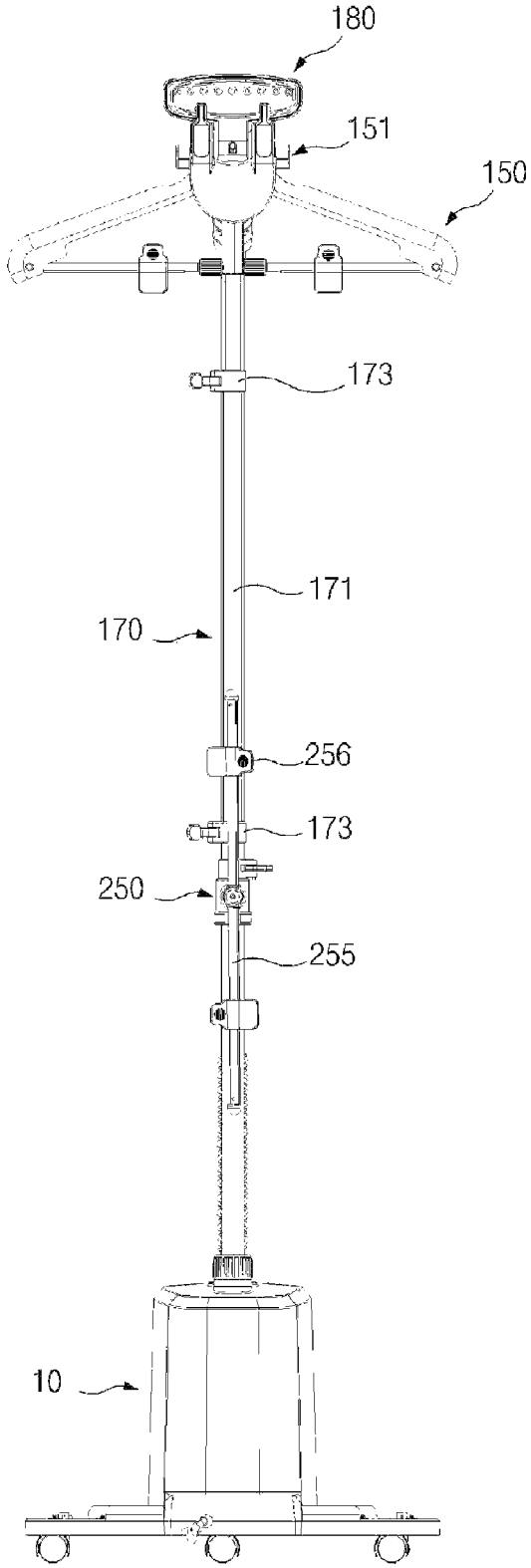

【Figure 3】
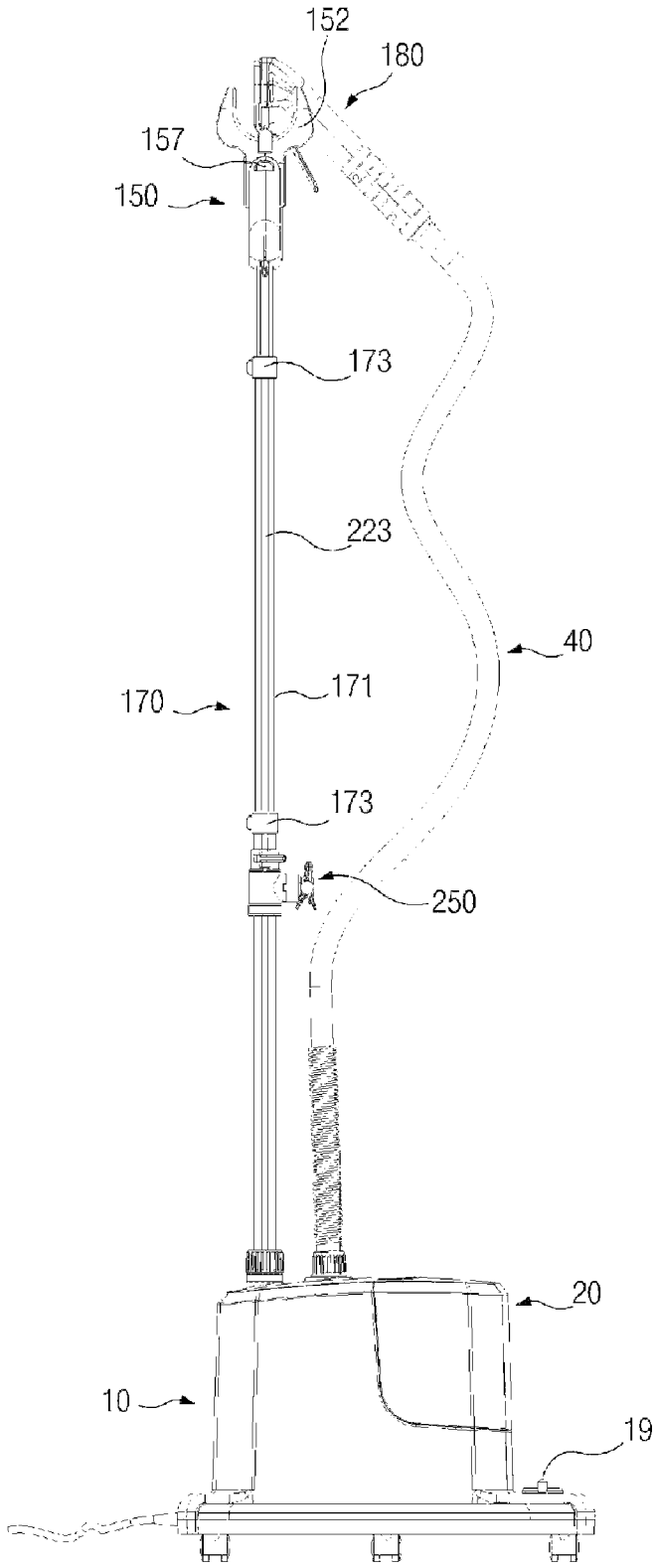

【Figure 4】
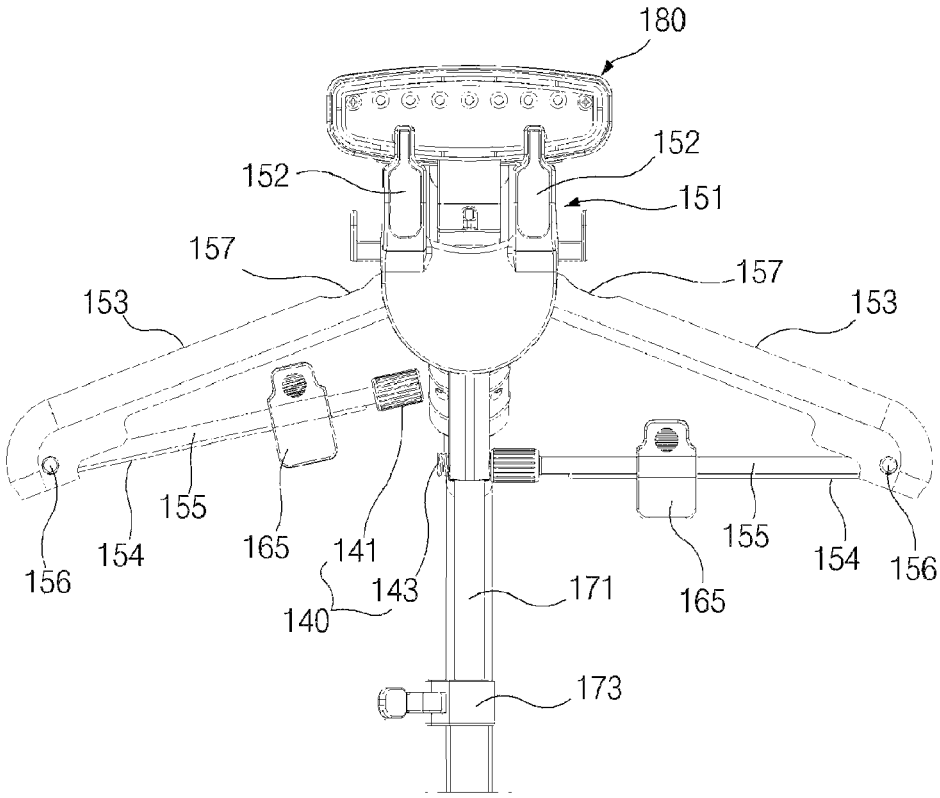

【Figure 5】
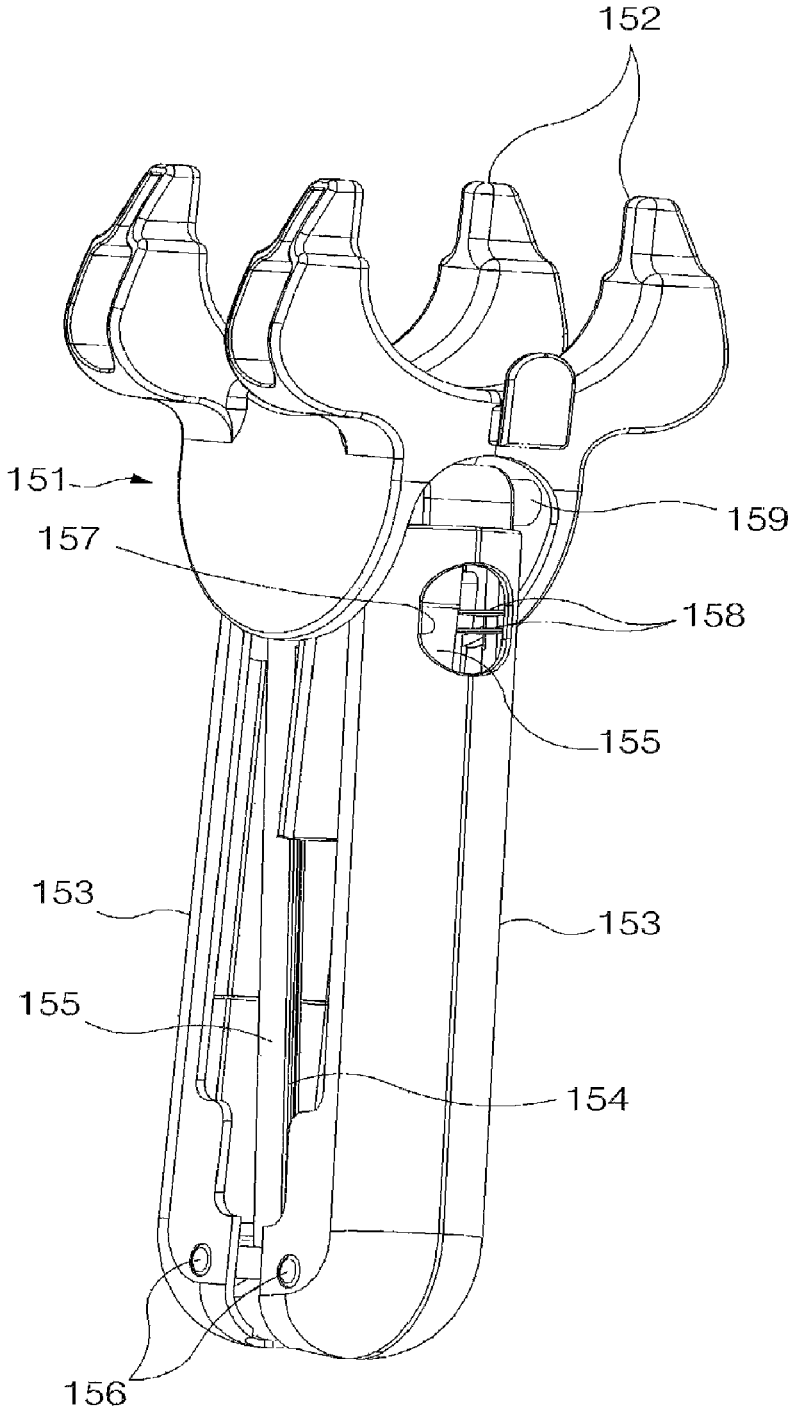

【Figure 6】
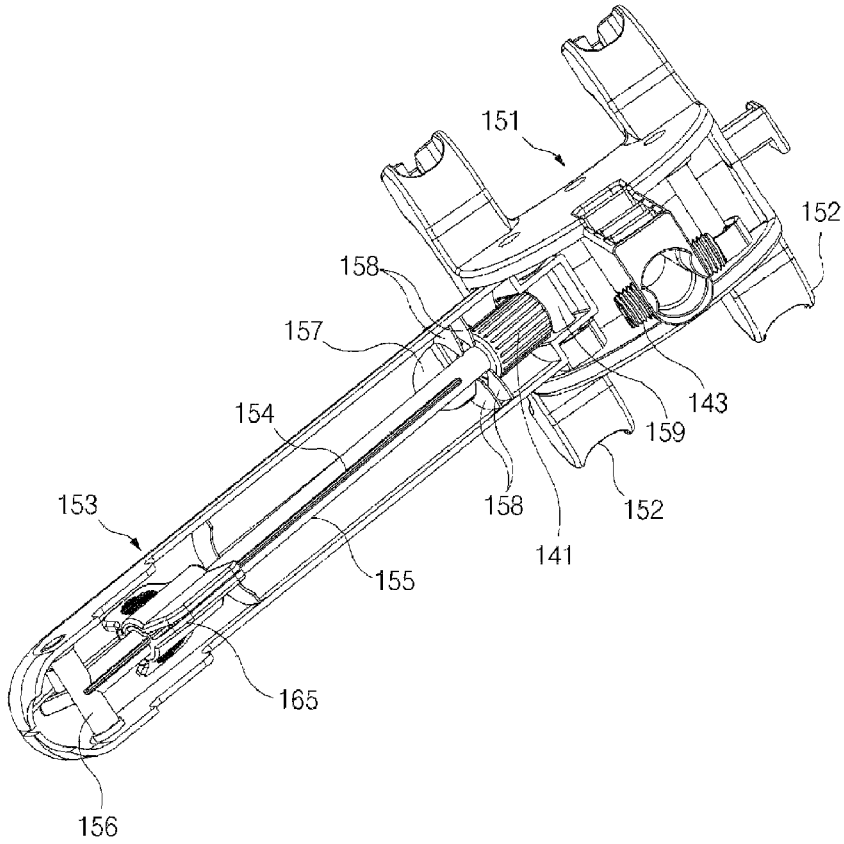
【Figure 7】
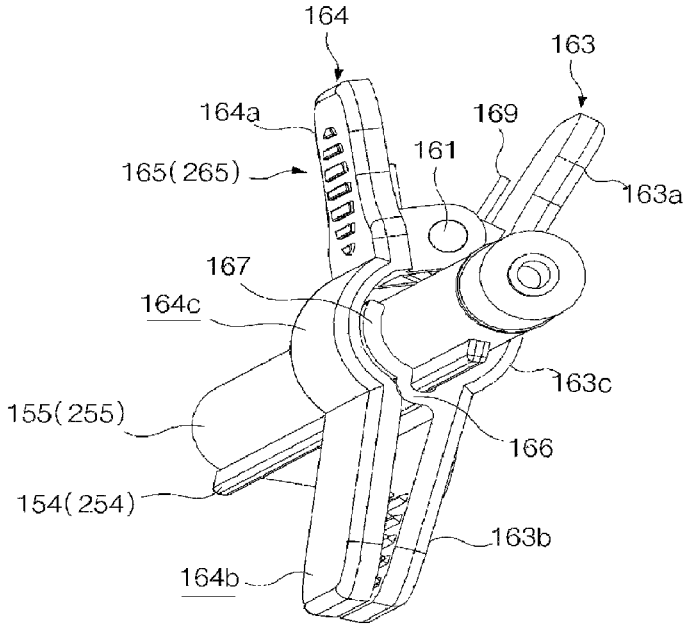

【Figure 8】
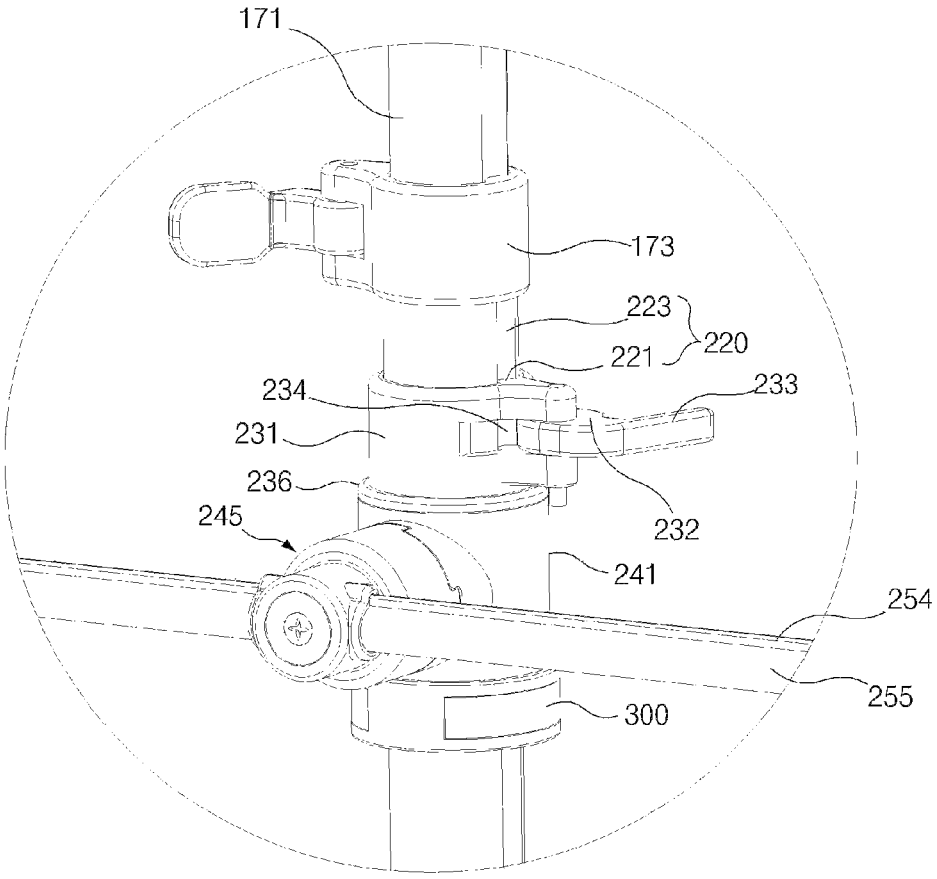

【Figure 9】
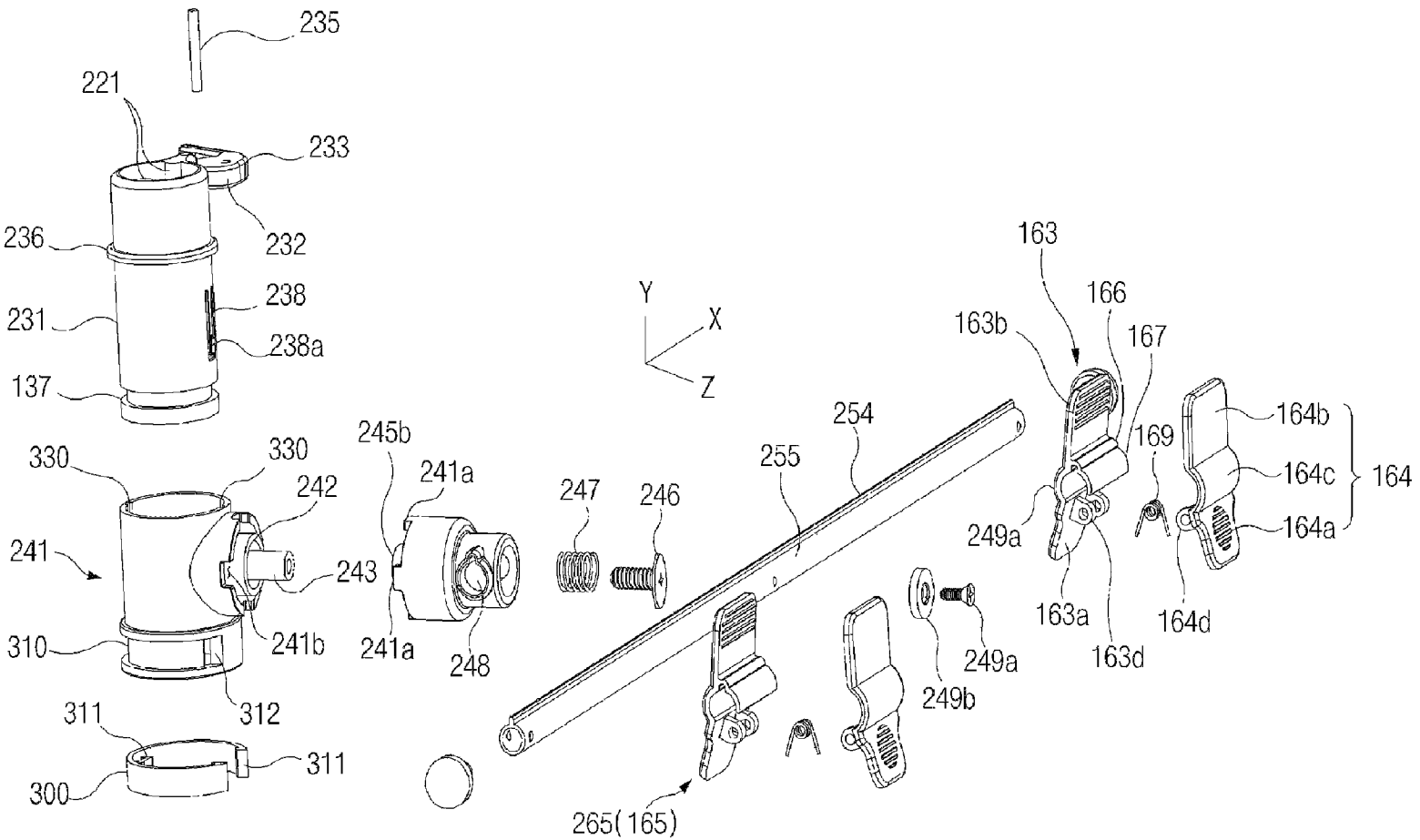

【Figure 10】
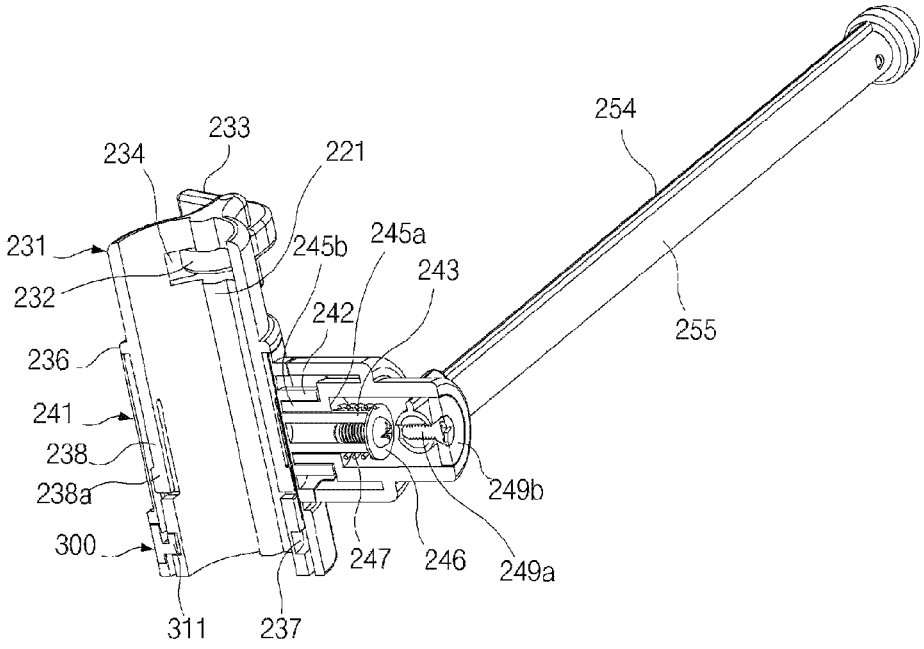

【Figure 11】
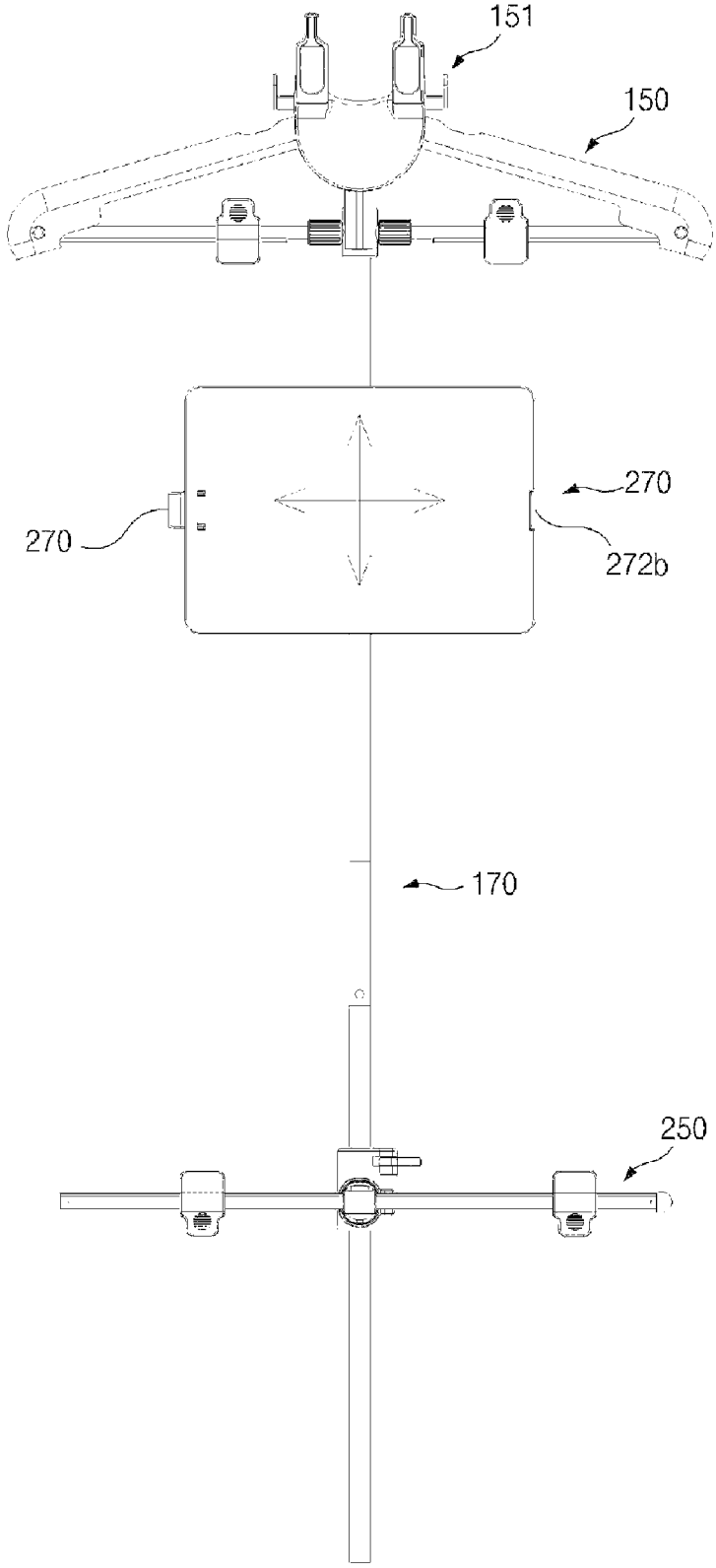

【Figure 12】
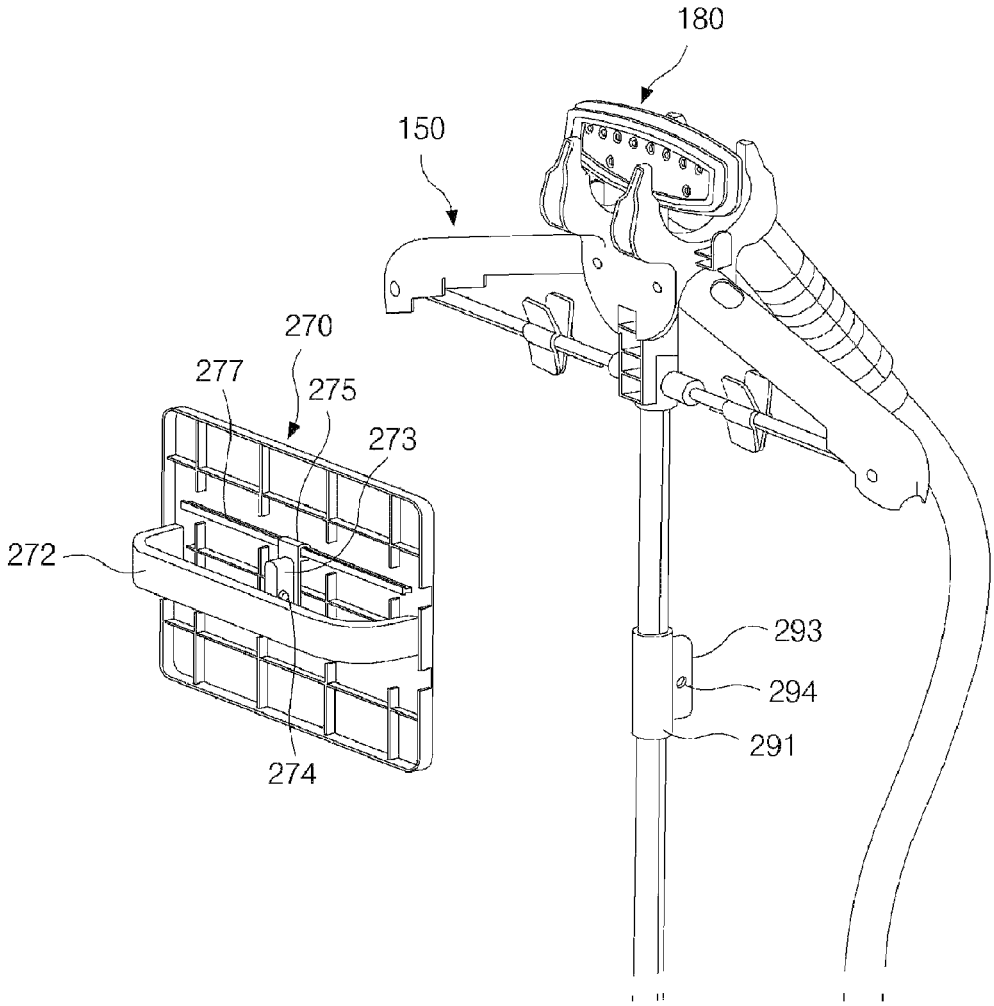

【Figure 13】
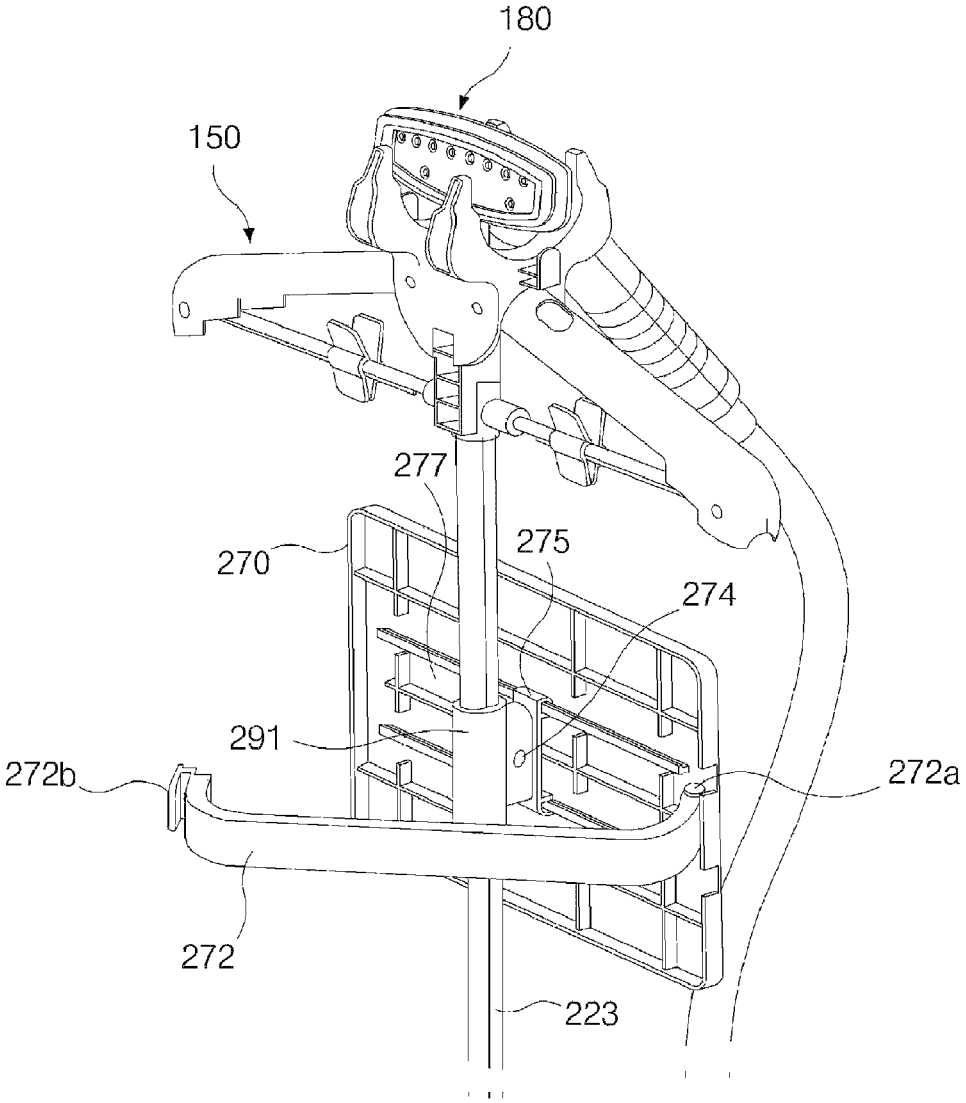

【Figure 14】
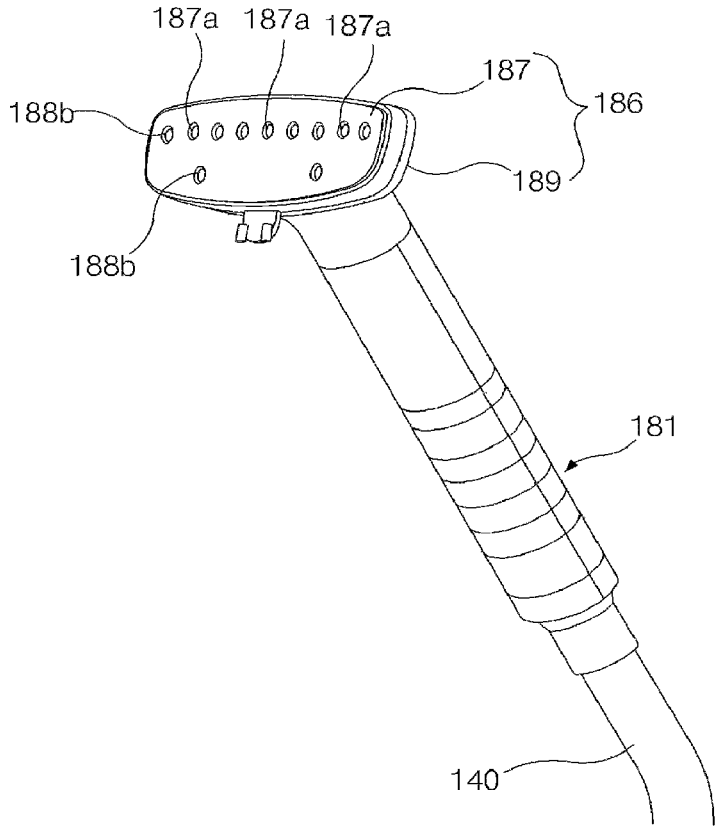
【Figure 15】
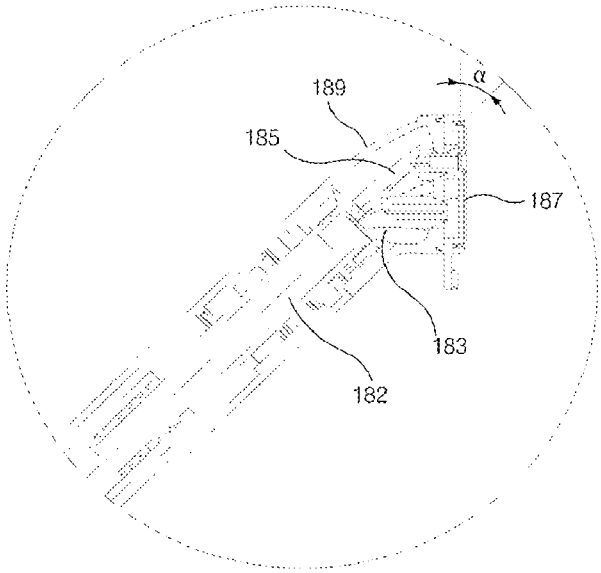

【Figure 16】
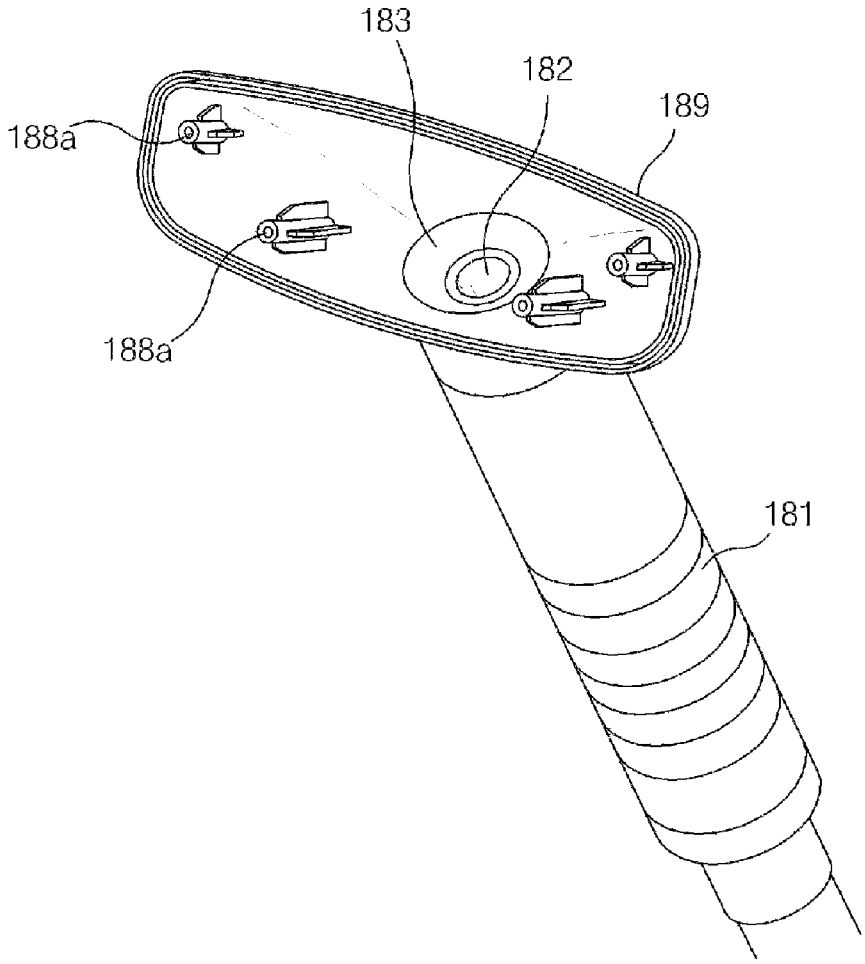

【Figure 17】
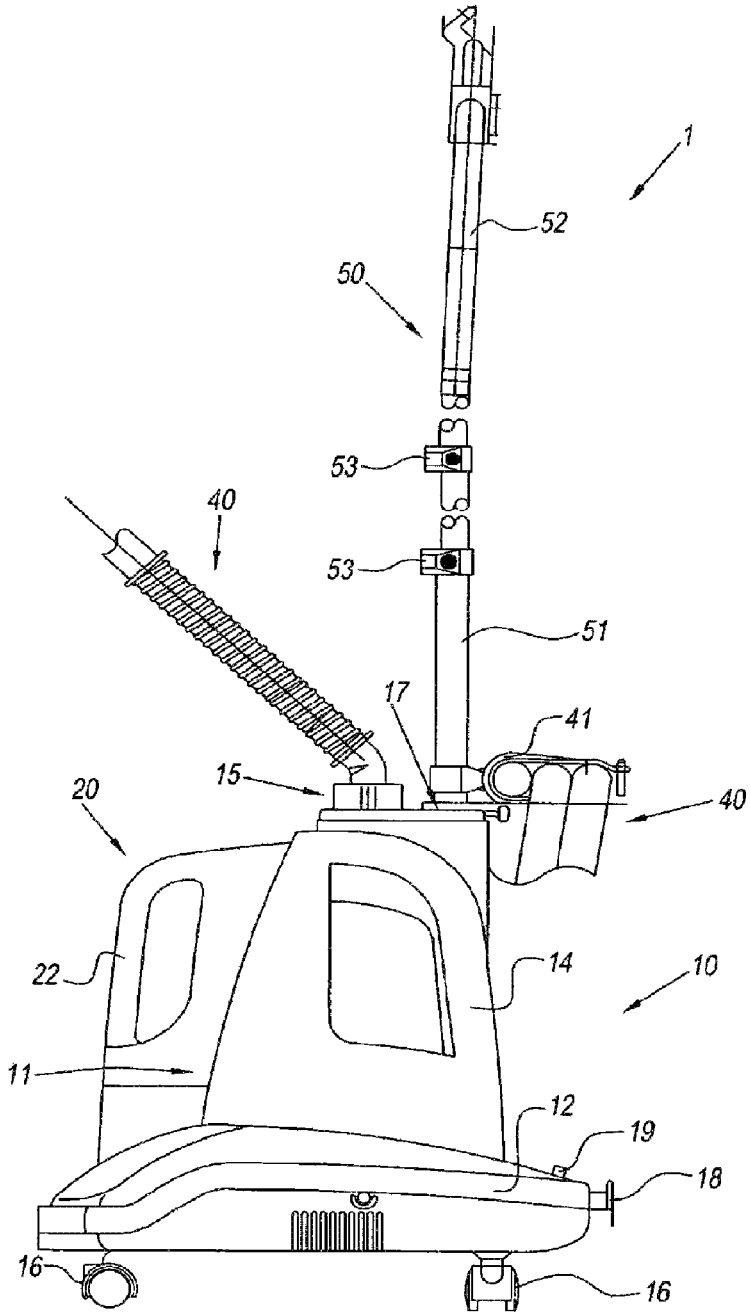
PRIOR ART

【Figure 18】
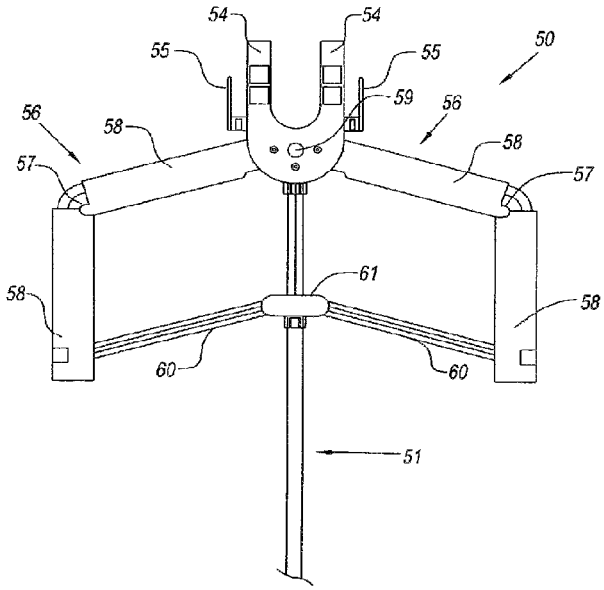
PRIOR ART
【Figure 19】
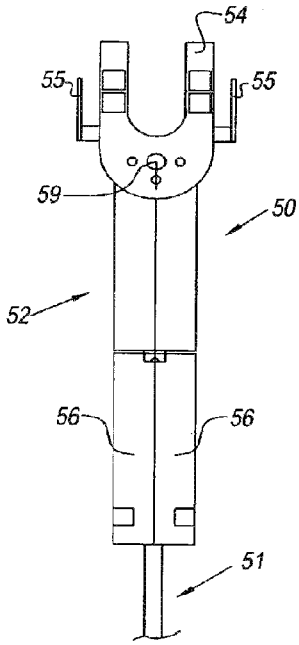
PRIOR ART

【Figure 20】
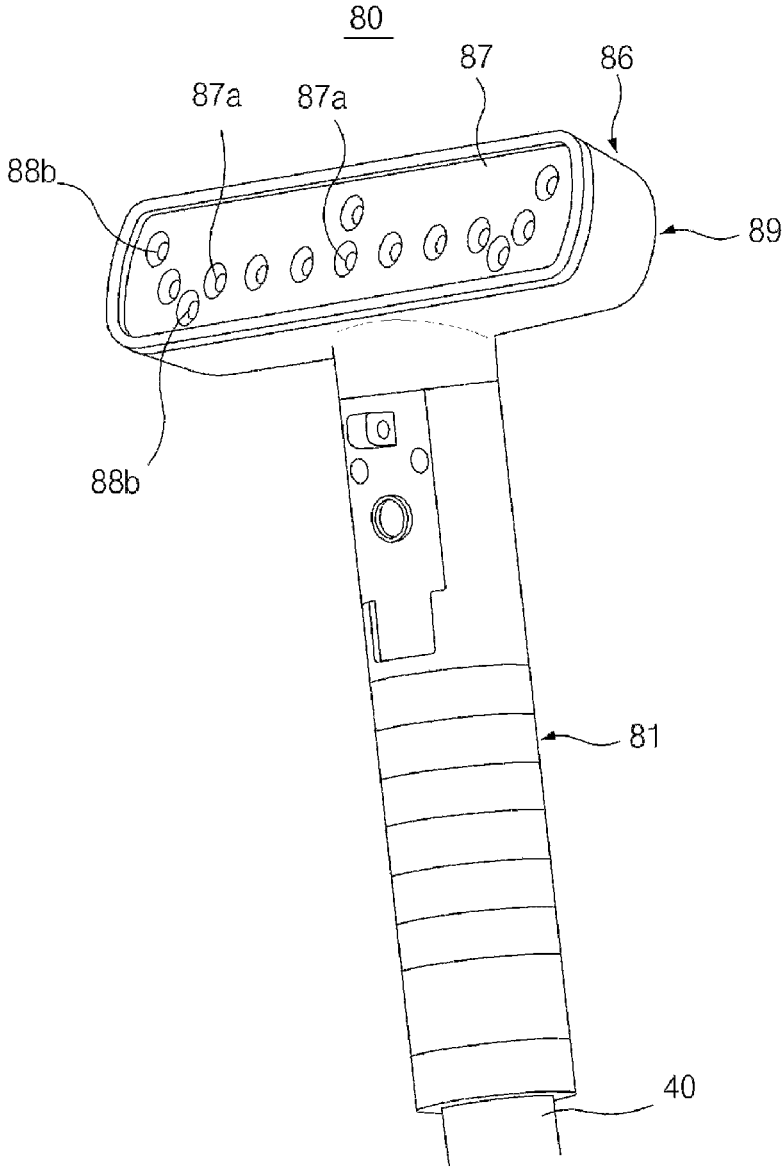
PRIOR ART

【Figure 21】
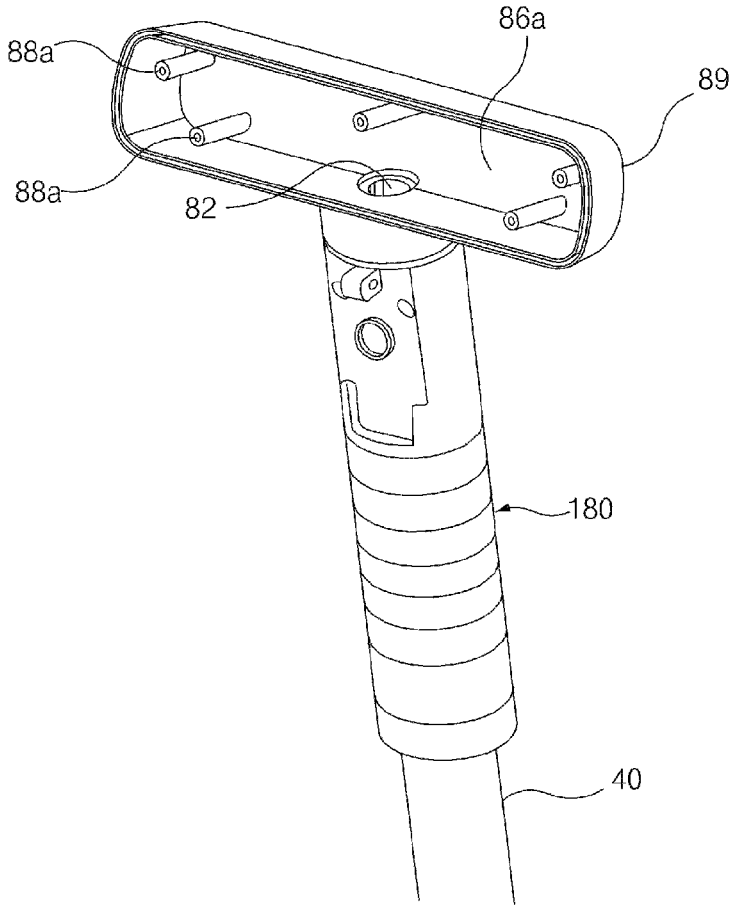
PRIOR ART

HANGER FOR GARMENT STEAMER

CROSS REFERENCE TO RELATED APPLICATIONS

This application is a 35 USC §371 National Phase Entry Application from PCT/KR2007/001282, filed Mar. 15, 2007, and designating the United States. This application claims priority under 35 U.S.C. §119 based on Korean Patent Application No. 10-2006-0024771 filed Mar. 17, 2006, and Korean Patent Application No. 20-2006-0007275 filed Mar. 17, 2006, which are incorporated herein in their entireties.

TECHNICAL FIELD

The present invention relates to a hanger of a garment steamer that is adapted for unrumpling clothing such as trousers, jackets, or the like. More particularly, the present invention relates to a hanger of a garment steamer, which employs ribs with a joining means for selectively engaging each one end thereof.

BACKGROUND ART

For example, a conventional garment steamer is disclosed in U.S. patent publication No. 2005/0132761. As shown in the accompanying FIGS. 17 to 19, the garment steamer (1) comprises a base (10) having a fluid heating assembly, a fluid container (20) in communication with the fluid heating assembly, a hose (40) in communication with the fluid heating assembly, a rod (51) telescopically connected to the base (10), and a hanger (52) connected to the rod (51) in a collapsible manner.

The hanger (52) comprises a hub (54) having one or more hanging supports (55), two arms (56) pivotally connected thereto, a lock/release button (59) for selectively positioning and securing the arms (56) at desired positions, and two ribs (60) operative in conjunction with a slider (61) that is slidable along the rod (51).

As illustrated in FIG. 18 of the cited prior art, the hose (40) is provided with a steam nozzle (80), which is composed of a handle part (81) whose lower end is connected to the hose (40), and a nozzle head part (86) formed at an upper end of the handle part (81), as shown in FIGS. 20 and 21. The handle part (81) is built with a steam passage (82) therein, which is in fluid communication with the hose (40). The nozzle head part (86) includes a plate (87) having steam emitting holes (87*a*) thereon, a case (86) defining a steam chamber (86*a*) along with the plate (87), and fastening means (88*a*, 88*b*) by which the case (86) and the plate (87) are fabricated together. A variety of accessories, for example, a straightening brush, a dust removing brush, or a fluff brush, may be attached to the front of the plate (87) as the need arises.

DISCLOSURE

[Technical Problem]

The aforementioned conventional garment steamer has drawbacks as follows. Firstly, when steaming trousers there is troublesomeness to prepare an additional hanger to be hung on the hanging supports (55) because the ribs (60) do not provide any grabbing means for trousers. If a grabbing means, such as a conventional clothespin is installed to the ribs (60), a pressing portion of the clothespin would always face toward ground due to the center of gravity thereof, which results in inconvenience in use. Moreover, there is risk to damage the ribs (60) in use because the ribs (60) are often made of synthetic resin having relatively lower supporting strength.

Secondly, considering one end of the rib (60) is rotatably coupled to the slider (61) that is slidable along the rod (51), external force applied to the rod may be transferred to the ribs (60) while causing an undesirable movement thereof, thereby disturbing steaming process.

Thirdly, though trousers can be somehow hung on the ribs (60) by using a certain grabbing means like a clothespin, a user should manually stretch the trousers for obtaining desired steaming effect. If the user conducts steaming process without manually stretching the trousers, not only rather long time would be taken to obtain desired steaming effect, but also it is not easy to crease the trousers.

Fourthly, the steaming effect is insufficient when steaming trousers or a jacket because there is not provided with an ironing board for the clothing. In case that steaming process exceeds a certain time in order to obtain sufficient effect, then it undesirably leads to wet the clothing.

Fifthly, the case is configured to direct water, which is generated by condensation at the plate as steam is being emitted from the steam passage, into the steam passage. For the purpose, an outlet of the steam passage is flatly formed at a bottom surface of the case. Thus, the water condensed in the case is often unintentionally overflowed through steam emitting holes (87*a*) during a steaming process, which results in wetting the clothing. Especially, this drawback should be seriously considered when the steam emitting holes (87*a*) are positioned adjacent to the bottom surface of the case, or below a horizontal centerline of the plate. (See FIG. 20)

[Technical Solution]

The present invention aims to solve the aforementioned drawbacks of a conventional garment steamer. Therefore, it is an object of the present invention to provide a garment steamer having an arm that is not subjected to an unintentional movement during steaming process. It is another object of the present invention to provide a garment steamer, which can be stored in a collapsible manner when not in use.

In order to accomplish the foregoing objects, a hanger of a garment steamer according to one aspect of the present invention comprises a hub, a plurality of arms whose proximal ends are pivotally coupled to the hub, a plurality of ribs, a hinge for connecting one end of each rib to a distal end of each arm, and a joining means configured to detachably connect the other end of the each rib to the hub. With such an arrangement, unintentional movement of the arms during steaming process is effectively prevented. Moreover, the arms can be stored in a collapsible manner when not in use.

Further to the foregoing embodiment, the arm may be further provided with a holding part that is employed for preventing the rib from being unintentionally released therefrom. In a further preferred embodiment, the arm includes an open-ended bottom through which the rib can be collapsed into the arm, and a penetrating hole adjacent to the holding part through which a user can readily push out the rib stored in the arm with his/her finger so as to release the arm from the holding part.

In the further preferred embodiment, the ribs of the hanger are furnished with clothespins, so that trousers or other clothing can be accommodated in the garment steamer without using an additional hanger for trousers.

Moreover, the rib may be provided with a key formed at a lower portion thereof, which serves not only to prevent a pressing portion of clothespin from facing toward the ground due to the center of gravity, but also to reinforce strength of the rib to which significant load is applied.

[Advantageous Effects]

As apparently shown in the foregoing description, a hanger of a garment steamer according to the present invention has advantages as follows.

Firstly, by providing a hanger of a garment steamer comprising a hub, a plurality of arms whose proximal ends are pivotally coupled to the hub, a plurality of ribs, a hinge for connecting one end of each rib to a distal end of each arm, and a joining means configured to detachably connect the other end of the each rib to the hub, the ribs can be firmly secured during steaming process for user's convenience. Moreover, it is convenient that the hanger can be stored in a collapsible manner when not in use.

Secondly, since the arm is provided with a holding part for preventing the rib from being unintentionally released therefrom, risk of user's injuries or damage of the ribs can be significantly reduced.

Thirdly, the arm has a channel-shaped cross section such that the rib can be stored therein in a collapsible manner, thereby accomplishing a pleasing outer appearance. Further, the penetrating hole facilitates for a user to readily push out the rib stored in the arm with his/her finger so as to release the arm from the holding part.

Fourthly, adoption of the clothespins on the rib enables the garment steamer to accommodate trousers as well as other clothing without using an additional hanger for trousers. Fifthly, by providing the ribs with the key that restrains the rotation of the clothespin, it prevents the pressing portion of a clothespin from facing toward the ground due to the center of gravity thereof, which results in inconvenience in use. Moreover, the key serves to reinforce strength of the rib.

DESCRIPTION OF DRAWINGS

FIG. 1 is a perspective view of a garment steamer according to a preferred embodiment of the present invention, in which a grabbing means in use is depicted;

FIG. 2 is a front view of a garment steamer according to a preferred embodiment of the present invention, in which a grabbing means not in use is depicted;

FIG. 3 is a side view of the garment steamer shown in FIG. 1, in which the grabbing means is backwardly rotated;

FIG. 4 is a front view of a hanger according to a preferred embodiment;

FIG. 5 is a side perspective view of the hanger illustrated in FIG. 4 as collapsed;

FIG. 6 is a perspective view, taken from a bottom, of the rib illustrated in FIG. 5, which is collapsed into an arm;

FIG. 7 is a perspective view of a clothespin of closed state of a preferred embodiment according to the present invention;

FIG. 8 is a partial perspective view of a grabbing means of a preferred embodiment according to the present invention;

FIG. 9 is an exploded perspective view of the grabbing means depicted in FIG. 8;

FIG. 10 is a sectional view of the grabbing means depicted in FIG. 8;

FIG. 11 is a front view showing an ironing board of a preferred embodiment according to the present invention;

FIGS. 12 and 13 are perspective views, taken from a rear direction, which shows an attachment/detachment state of the ironing board illustrated in FIG. 11;

FIG. 14 is a perspective view of a steam nozzle of a preferred embodiment according to the present invention;

FIG. 15 is a sectional view of the steam nozzle of FIG. 14;

FIG. 16 is a perspective view showing the inside of the steam nozzle of a preferred embodiment according to the present invention, wherein a plate is eliminated therefrom for visibility;

FIG. 17 is a side view of a conventional garment steamer;

FIGS. 18 and 19 are front views of the conventional garment steamer in FIG. 17, in which a hanger is expanded and collapsed, respectively;

FIG. 20 is a perspective view of a steam nozzle part according to a conventional garment steamer; and FIG. 21 is a perspective view showing the inside of the steam nozzle of a conventional garment steamer, wherein a plate is eliminated therefrom for visibility.

BEST MODE

Hereinafter, the present invention will be described in detail with reference to the accompanying drawings, wherein elements substantively identical with those of the prior art are denoted by the same numerals as the prior art, and detailed explanation on which is omitted.

FIG. 1 is a perspective view showing a garment steamer according to a preferred embodiment of the present invention, in which a grabbing means in use is depicted. Meanwhile, FIG. 2 is a front view of the garment steamer of the preferred embodiment, in which the grabbing means not in use is depicted. FIG. 3 illustrates a side view of the garment steamer in FIG. 1, in which the grabbing means is backwardly rotated.

As shown in FIGS. 1 to 3, the garment steamer according to the embodiment of the present invention comprises a base (10), a fluid container (20), a hose (40), a hanger (150), and a rod assembly (170). Further, one end of the hose (40) is preferably furnished with a steam nozzle (180).

The base (10) is composed of a wide relatively lower portion (12) and a tall relatively upper portion (14), which is adapted for lowering the center of gravity thereof closer to the ground thereby improving the overall stability of the device. The lower portion (12) and the upper portion (14) each enclose a portion of a fluid heating assembly (30). (See FIG. 2 of the cited US patent publication)

Installed on a bottom surface of the lower portion (12) are a plurality of casters (16). Moreover, the lower portion (12) is equipped with a control part (19) thereon, at which operating button is mounted. The upper portion (14) encompassing the fluid container (20) includes a first connector (13) coupling the fluid container (20) to the fluid heating assembly (30), a second connector (15) coupling the fluid heating assembly (30) to the hose (40), and a third connector (17) coupling the rod assembly (150) to the upper portion (14). One end of the hose (40) is coupled to the second connector (15) and the other end of which is separably coupled to the steam nozzle (180). Preferably, the hose (40) is embodied in the form of a flexible insulating hose. The rod assembly (170) is composed of a telescopic rod (171) whose lower end is fixed to the base (10) and a plurality of locks (173) adapted for securely locking the telescopic rod (171) at a desired position.

As shown in FIGS. 4 and 5, the hanger (150) comprises a hub (151) mounted on the upper end of the rod (171), arms (153) whose proximal ends are pivotally joined to both side of the hub (151), and at least two ribs (155), one ends of which are pivotally connected to distal ends of the arms (153) and the other ends of which are coupled to the rod (171). Preferably, the hub (151) is furnished with a nozzle rest (152), on which the steam nozzle (180) is placed. Because the arm (153) is configured to pivot on a hinge shaft (159), the arm (153) is collapsible with respect to the hub (151). Likewise, the proximal end of the rib (155) is pivotally coupled to the arm (153) by means of a hinge shaft (156) and the distal end of the rib (155) is coupled to the hub (151) via a joining means (140).

The joining means (140) may be embodied by nuts (141) installed at the distal ends of the ribs (155) and bolts (143) formed on both sides of a prolonged portion extending from the lower portion of the hub (151). Of course, it should be appreciated that such a joining means (140) can be embodied in a variety of forms by a person having an ordinary skill in the art. For example, a frictional-fit means or a snap-fit mean can be applicable. With the arrangement of the joining means (140), it is possible to securely fix the ribs (155) to the hub while preventing a movement of arms (153), thereby firmly fixing clothing during a steaming process.

As shown in FIGS. 5 and 6, it is preferable to provide the arm (153) with a holding part (158) in which the collapsed rib (155) is received. The holding part (158) may be embodied in the form of a C-shaped or a channel-shaped snap ring. Thus, once the rib (155) is snapped into the holding part (158), unintended movement of the rib (155) is inhibited even though the arm (153) is extended. Moreover, in order to conceal the rib (155) and a clothespin (165) (details of which will be followed later) when the arm (153) is collapsed, the bottom of the arm (153) is opened so that the arm has a channel-shaped or an arch-shaped section. (See FIG. 6) Preferably, the arm (153) further comprises a penetrating hole (157) adjacent to the holding part (158). The release of the rib (155) snapped into the holding part (158) can be readily rendered by pushing out the rib (155) through the penetrating hole (157).

The ribs (155) are furnished with clothespins (165), which are preferably slidable along the ribs (155). Referring to FIGS. 7 and 9, the clothespin (165) is mainly composed of a first clip piece (163), a second clip piece (164), a hinge shaft (161) pivotally coupling the first clip piece (163) and the second clip piece (164), and a spring (169). Each clip piece (163, 164) comprises pressing portions (163*a*, 164*a*), grabbing portions (163*b*, 164*b*), and bending portions (163*c*, 164*c*) that integrally connect the pressing portions and the grabbing portions. The bending portions (163*c*, 164*c*) are disposed encircling the rib (155) so as to be slidable along the rib. The hinge shaft (161) passes through a male flange (164*d*) and a female flange (163*d*). Preferably, the spring (169) is a torsional coil spring.

With the arrangement of the clothespin (165), the garment steamer according to the present invention can accommodate trousers as well as shirts. Thus, an additional hanging means for trousers is not necessary since the hanger (150) can accommodate trousers as well as shirts.

Because the center of gravity of the clothespin (165) is generally located closer to the pressing portions, the pressing portions of the clothespin (165) faces toward the ground as mounted to the rib (155). For the reason, when using the clothespin (165), a user has to rotate it by 180 degree around the rib (155) or dismount it from the rib (155). In order to eliminate such inconvenience, the rib (155) is preferably provided with a key (154) formed along the longitudinal direction at the lower portion thereof. The grabbing portions (163*b*, 164*b*) or the boundary where the grabbing portions (163*b*, 164*b*) and the bending portions (163*c*, 164*c*) meet interferes with the key (154), thereby preventing the rotation of the clothespin (165) with respect to the rib (155). Moreover, the key (154) serves to supplement strength of the rib (155). Therefore, in case that the ribs are made of plastic material with a relatively small diameter, the key (154) is especially preferred.

For more stable engagement with the key (154), the clothespin (165) may be provided with a key-guide groove (166). As shown in FIGS. 7 and 9, a guide member parallel to the hinge shaft (161) is formed at an inner surface of the first clip piece (163). The guide member comprises a first extending portion (166) and a second extending portion (167). The first extending portion (166) forms the key-guide groove (166) into which the key (154) is inserted such that the rotation of the clothespin (165) with respect to the rib (155) is restrained. The second extending portion (167) extending from the key-guide groove (166) serves to further prevent rotation and derailment of the clothespin (15) with respect to the rib (167), while partially enclosing the rib (167).

As shown in FIGS. 1 and 3, preferably the garment steamer according to the present invention further comprises a grabbing means (250) capable of stretching trousers during a steaming process, thereby enhancing steaming effect.

Similarly to a conventional hanger for trousers, the grabbing means (250) comprises a bar (255) and a clothespin (265) installed to the bar. The bar (255) may be equipped with a key (254) as described above. The key (254) serves not only to improve strength of the bar (255), but also to restrain the clothespin (265) from unintentionally sliding along the bar (255) when moving the bar (255).

The grabbing means (250) is provided with a height adjusting means (230) that varies a vertical location thereof along the rod, so that the grabbing means (250) can be adaptive to clothing of any size. Referring to FIGS. 8 to 10, the height adjusting means (230) includes a first slider (231) moving along the rod (171) and a lock/release lever (233) for selectively positioning and securing the first slider (231) at desired positions. As the lock/release lever (233) rotates, a disk (232) integrally formed with the lever (233) is inserted into a slot (234) formed on the first slider (231) while pressing the rod (171) enclosed in the first slider (231), whereby the height adjusting means (230) can be locked at any desired positions. The release is rendered by rotating the lock/release lever (233) in a direction that the disk (232) is moved away from the rod (171). The lock/release lever (233) is pivotally coupled to the first slider (231) by means of a hinge shaft (235).

Moreover, there is preferably provided with a Z-axis rotator (240), which selectively positions the grabbing means (250) to be parallel to the rod (Y-axis) or perpendicular to the rod (X-axis) by rotating the bar on Z-axis with respect to the height adjusting means (230). Namely, as shown in FIGS. 1 and 3, the bar (255) is positioned perpendicular to the rod (171) (X-axis) when in use. As shown in FIG. 2, the bar (255) is oriented parallel to the rod (171) (Y-axis) when not in use.

Referring to FIGS. 9 and 10, the Z-axis rotator (240) comprises an outer cylinder (241) encompassing the first slider (231), a supporting shaft (243) outwardly extended from the outer cylinder (241) in a Z-axis direction, a Z-axis rotating part (245) that rotates on the supporting shaft (243) while supporting the bar (255), and a spring (247) configured to bias the Z-axis rotating part (245) toward the outer cylinder (241). The bar (255) is inserted into an opening (245) formed on the Z-axis rotating part (245) while aligning the center thereof with the Z-axis rotating part. Thereafter, the bar (255) is fixed to the Z-axis rotating part (245) by a screw (249*a*) passing through a lid (249*b*). As apparently depicted in FIG. 10, the spring (247) is disposed around the supporting shaft (243) while one end of which is supported by the head of a screw (246) that is fastened to the supporting shaft (243) and the other end of which is supported by a step (245*a*) built in the Z-axis rotating part (245). A protruding end (245*b*) extending from the step (245*a*) is interposed between the supporting shaft (243) and a surrounding barrier (242), whereby guiding stable rotation of the Z-axis rotating part (245).

Moreover, the Z-axis rotating part (245) employs an engagement means for firmly securing the position thereof and positioning the same at only predetermined locations, for example, at every 90 degree. Such engagement means may be embodied in the form of a jaw clutch consisting of prominences (241*a*) and depressions (241*b*) formed on the Z-axis rotating part (245) and the outer cylinder (241), respectively. Due to the interference between the prominences (241*a*) and the depressions (241*b*), when rotating the bar (255), the Z-axis rotating part (245) should be pulled out first so as to disengage the prominences (241*a*) from the depressions (241*b*). After rotating the bar (255), the Z-axis rotating part (245) is configured to automatically return to an initial position by the biasing spring (247), thereby the prominences (241*a*) and the depressions (241*b*) are engaged with each other.

Further, there is provided with a Y-axis rotator that rotates the bar (255) around the rod (171). The Y-axis rotator may be embodied by configuring the outer cylinder (241) to be rotatable with respect to the first slider (231). In order to locate the outer cylinder (241) at a predetermined position, a cantilever (238) having a claw (238*a*) at a free end thereof is provided on the outer surface of the first slider (231). Formed on the inner surface of the outer cylinder (241) are fitting grooves (330) in which the claw (238*a*) of the cantilever (238) is engaged. Therefore, a user may find a predetermined position by rotating the outer cylinder (241) on Y-axis until the claw (238*a*) fits into the fitting grooves (330).

The first slider (231) may preferably include a means for preventing the outer cylinder (241) from being escaped therefrom. Specifically, the first slider (231) is furnished a circumferential rim (236) formed on the upper portion thereof and a groove (237) formed on the lower portion along the circumference thereof.

Meanwhile, fitting apertures (312) are formed on the lower portion of the outer cylinder (241) at regular intervals. There is provided a C-shaped ring (300) having projections (311) which are fit into the groove (237) passing through the fitting apertures (312). The C-shaped ring (300) is received within a recess (310) formed around the fitting apertures (312). Therefore, the outer cylinder (241) is coupled with the first slider (231) while preventing vertical escape of the outer cylinder (241) from the first slider (231) by means of the circumferential rim (236) and the projections (311).

The garment steamer of the present invention further includes an aligner (220) that configures the bar (255) to be on the same plane (X-Y plane) with the ribs (155). As shown in FIG. 8, the aligner (220) comprises a position determining convex (221) formed on the inner surface of the first slider (231) and a position determining groove (233) formed on the rod (171) in a longitudinal direction. The aligner (220) prevents the first slider (231) from freely rotating with respect to the rod (171), whereby arranging the bar (255) to be on the same plane (X-Y plane) with the ribs (155). Moreover, the aligner (220) serves to facilitate stable movement along the rod (171).

It is well known that the use of an ironing board during a steaming process improves ironing effect. Considering that, the garment steamer according to the embodiment of the present invention is provided with an ironing board (270) on the rod (171) as illustrated in FIGS. 11 to 13. The ironing board (270) is disposed below the hanger (150) or between the hanger (150) and the grabbing means (250). The ironing board (270) is attached to a second slider (291) that is slidable along the rod (171). The second slider (291) may employ a lock/release means similarly to the first slider (231). However, it is preferable to embody in the form of a freely slidable pipe on the rod (171).

The second slider (291) is equipped with a female flange (293) having an inserting slit. Correspondingly, the ironing board (270) comprises a male flange (273) adapted for being inserted into the inserting slit of the female flange (293). By such an arrangement, the second slider (291) and the ironing board (270) are fabricated together. Preferably, the male flange (273) includes an elastic jut (274). Correspondingly, the female flange (293) includes a fitting hole (294) into which the jut (274) is fit. With the cooperation of the jut (274) and the fitting hole (294), unintended separation of the ironing board (270) in a direction of Z-axis is suppressed.

Preferably, the ironing board (270) slidably moves in a perpendicular direction (X-axis) of the rod (171). In particular, the ironing board (270) comprises guide rails (277) formed on the rear surface thereof and a sledge (275) sliding along the guide rails (277). The male flange (273) is mounted on the sledge (275). Of course, the male flange (273) may be integrally formed with the sledge (275). The sledge (275) has a saddle-like shape, both sides of which are engaged with the guide rails (277). As described above, since the ironing board (270) is freely movable in a direction of X-axis and Y-axis, the ironing board (270) covers most area of clothing even though the size thereof is relatively small. With such an arrangement, the ironing board (270) can be readily located at a desired position. The ironing board (270) may further comprise a handle (272) facilitating the operation thereof. The handle (272) may be attached to a lateral surface or a rear surface of the ironing board (270). In the embodiment, for an aesthetically pleasing appearance, the handle (272) is disposed on the rear surface of the ironing board (270), one end of which is pivotally jointed to the ironing board (270) by a hinge (272*a*) and the other end of which is furnished with a friction-fit means (272*b*). The friction-fit means (272*b*) also serves to prevent escape of the sledge (275) from the guide rails (277).

Further, one end of the hose (40) is furnished with a steam nozzle (180) to be nested in a nozzle rest. As shown in FIGS. 14 to 16, the steam nozzle (180) comprises a substantially T-shaped nozzle head part (186) and a handle part (181). A steam passage (182) is built in the handle part (181), which is in fluid communication with the hose (40). The nozzle head part (186) coupled to the upper end of the handle part (181) comprises a plate (187) having steam emitting holes (187*a*) thereon, a case (189) defining a steam chamber (185) along with the plate (187), and fastening means (188*a*, 188*b*) by which the case (189) and the plate (187) are fabricated together. The steam passage (181) is downwardly slanted by degree of $\alpha$ with respect to the plate (187). Inside the case (189), a funnel-shaped portion (183) is formed at which the steam passage (181) is connected to the case (189).

With such an arrangement, it is possible to shorten the time that water produced by condensation of steam stays in the chamber (185), by readily directing the water into the steam passage (181) owing to the funnel-shaped portion (183). Therefore, the garment steamer according to the present invention is capable of significantly decreasing apprehension that clothing is wet by water overflowing through steam emitting holes (187*a*).

Moreover, the steam emitting holes (187*a*) are preferably arranged adjacent to the upper portion of the case (189). Namely, the steam emitting holes (187*a*) are disposed above a horizontal centerline of the plate (187). This shows a similar effect that flooding can be suppressed by increasing height of a dam.

INDUSTRIAL APPLICABILITY

Even though the present invention is described in an exemplary manner with reference to the aforementioned embodiment, the present invention is not limited by the embodiment and can be modified or varied without departing from the inventive concept thereof.

The invention claimed is:

1. A hanger for a garment steamer, the hanger comprising:

a hub;

a plurality of arms whose proximal ends are pivotally coupled to the hub;

a plurality of ribs each provided with a key formed at a lower portion thereof;

a hinge for connecting one end of each rib to a distal end of each arm;

a joining means configured to detachably connect the other end of the each rib to the hub; and clothespins partially enclosing the ribs, each clothespin comprising a first clip piece, a second clip piece, a hinge shaft pivotally coupling the first clip piece and the second clip piece, and a spring; each of said clothespins having a first extending portion formed at an inner surface of the first clip piece and a second extending portion extending from the first extending portion configured to prevent rotation and derailment of each clothespin with respect to each of said ribs, wherein said key is inserted into said first extending portion.

2. The hanger according to claim 1, wherein the arm is further provided with a holding part adapted for holding the ribs.

3. The hanger according to claim 2, wherein the arm comprises an open-ended bottom and a penetrating hole adjacent to the holding part.

4. The hanger according to claim 1, further comprising a rod whose upper portion is connected to the hub and a grabbing means disposed to a lower portion of the rod.

* * * * *